United States Patent [19]

Perkins

[11] Patent Number: 4,522,262

[45] Date of Patent: Jun. 11, 1985

[54] SINGLE WELL ELECTRICAL OIL STIMULATION

[75] Inventor: Thomas K. Perkins, Dallas, Tex.

[73] Assignee: Atlantic Richfield Company, Los Angeles, Calif.

[21] Appl. No.: 509,736

[22] Filed: Jun. 30, 1983

[51] Int. Cl.[3] ..... E21B 36/04; E21B 43/24

[52] U.S. Cl. ..... 166/248; 166/60

[58] Field of Search ..... 166/248, 272, 302, 60

[56] References Cited

U.S. PATENT DOCUMENTS

| | | | |
|---|---|---|---|
| 2,099,328 | 11/1937 | Casagrande | 166/248 |
| 3,547,193 | 12/1970 | Gill | 166/248 |
| 3,946,809 | 3/1976 | Hagedorn | 166/248 |
| 4,084,639 | 4/1978 | Todd | 166/248 |
| 4,196,329 | 4/1980 | Rowland et al. | 166/248 |
| 4,401,162 | 8/1983 | Osborne | 166/248 |
| 4,463,805 | 8/1984 | Bingham | 166/60 |

*Primary Examiner*—Stephen J. Novosad
*Assistant Examiner*—William P. Neuder
*Attorney, Agent, or Firm*—M. David Folzenlogen

[57] ABSTRACT

A single well method and apparatus for electrically applying heat and stimulating is comprised of a relatively lower surface area formation electrode and relatively high surface area overburden electrode extending downward into the borehole past low resistivity water zones. This long overburden electrode may be formed of nonmagnetic metal to reduce hysteresis losses in the electrode. This improved single well system causes most of power to be dissipated in the oil pay zone and thereby renders single well production economical.

9 Claims, 1 Drawing Figure

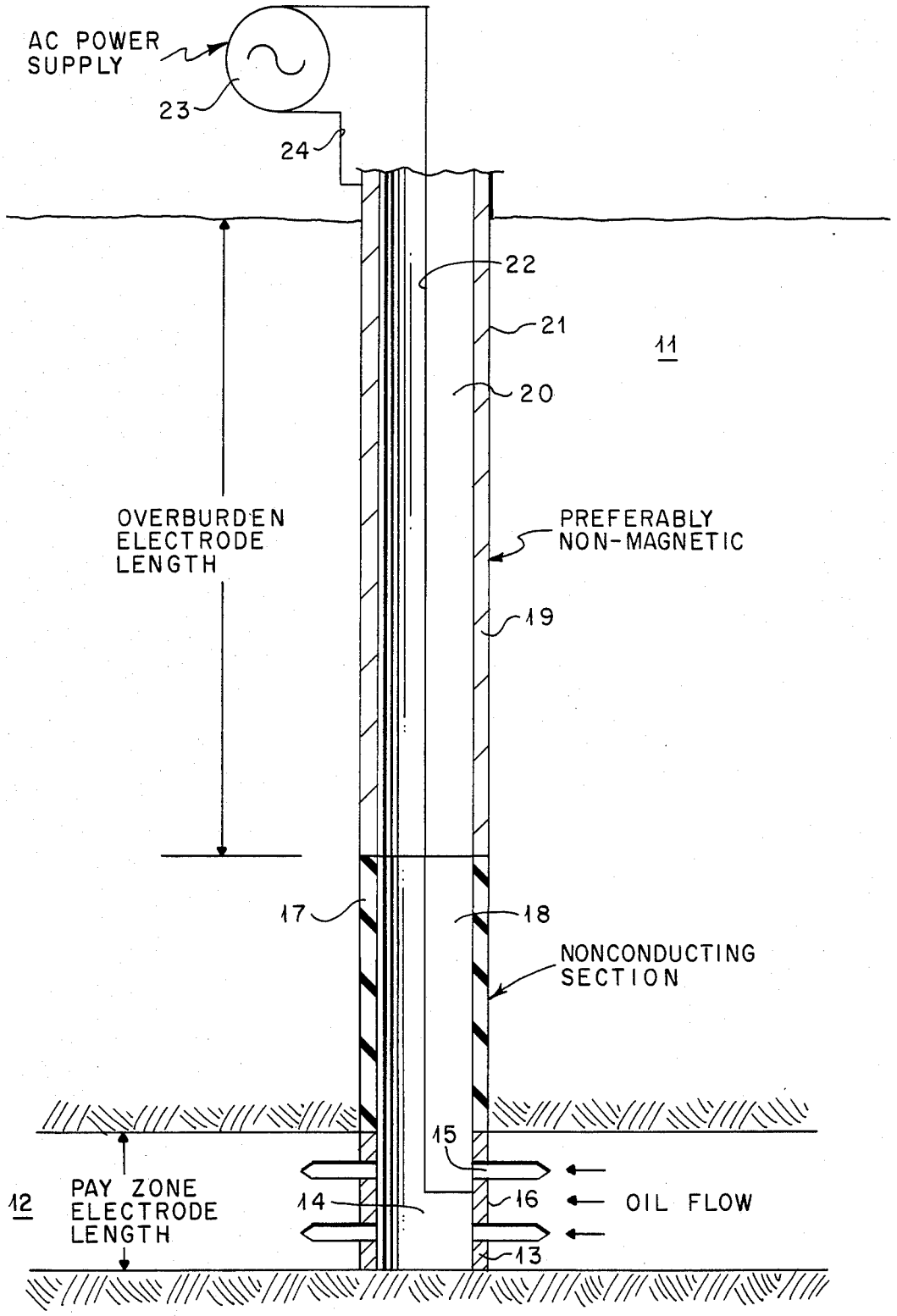
AC POWER SUPPLY
23
24
22
21
11
20
OVERBURDEN ELECTRODE LENGTH
PREFERABLY NON-MAGNETIC
19
17
18
NONCONDUCTING SECTION
15
12
PAY ZONE ELECTRODE LENGTH
14
16
OIL FLOW
13

SINGLE WELL ELECTRICAL OIL STIMULATION

BACKGROUND OF THE INVENTION

This invention relates to an improved system for using electricity to stimulate production of viscous hydrocarbons from subsurface formations. More particularly, a single well system is divided into a long metal overburden electrode and a relatively short metal electrode in the oil pay zone formation.

Large relatively shallow deposits of viscous hydrocarbonaceous substances whose viscosity is decreased by heat, like for example, the Ugnu formation in Alaska, are known to exist in subterranean formations. Many techniques have been proposed for tar sands, viscous crude oils and other similar hydrocarbons. Relatively recently it has been proposed to use electrical current to add heat to a subsurface pay zone containing tar sands or viscous oil. Two electrodes are connected to an electrical power source and are positioned at spaced apart points in contact with the earth. Although a single well system has been proposed, it has generally been believed that a single well system is not economically feasible. The patented art, for example, U.S. Pat. Nos. 3,642,066; 3,874,450; 3,848,671; 3,948,319; 3,958,636; 4,010,799 and 4,084,637 stress passing current between laterally spaced apart electrodes.

SUMMARY OF THE INVENTION

It has been found that viscous hydrocarbonaceous materials can be efficiently produced from a single well by electrical heating if the relative resistance near the pay zone is high and much of the power is dissipated in the pay zone, thereby concentrating electrical heat at the pay zone and stimulating production through the single well. Moreover, the efficiency of the system is increased if magnetic hysteresis losses are reduced in the overburden area. Accordingly, it is an object of this invention to provide a more efficient single well system for applying electrically created heat to a subsurface formation containing a viscous hydrocarbonaceous material. It is another object of this invention to provide an improved single well electrode arrangement for selectively applying electrically generated heat to a subterranean formation that contains viscous oil-like substances.

The improved single well electrode configuration of this invention is comprised of a relatively short tubular electrode positioned in a formation containing hydrocarbonaceous material and a relatively long tubular electrode positioned in the overburden overlying the hydrocarbon containing formation. The overburden electrode and formation electrode are electrically separated from each other by an intermediate electrically nonconducting tubular member. The electrodes are connected to an alternating current power source. The relatively long overburden electrode has a relatively large surface area in contact with the overburden which contains low resistance water zones. The relatively short formation electrode has a relatively small surface area in contact with the subsurface formation which contains hydrocarbonaceous material with a resistance significantly greater than the formation waters in the overburden. The surface area of the overburden electrode is at least five times larger than the surface area of the formation electrode. When alternating current is passed between the electrodes and the formation and overburden, the relative high resistance of the formation electrode causes most of the power to be dissipated in the formation and the resulting power loss heats and stimulates the hydrocarbonaceous material causing fluid oil to flow into the tubular formation electrode. The oil is produced through tubular members, which may or may not be the electrodes, to the surface of the earth.

In a further aspect of this invention, the efficiency of the system is increased further. The overburden electrode is comprised of an electrically conductive nonmagnetic material, preferably aluminum. This reduces magnetic hysteresis losses in the area of the overburden.

BRIEF DESCRIPTION OF THE DRAWING

This drawing is a side elevational view, partly schematic and partly in section, illustrating a simplified embodiment of the electrode configuration.

DESCRIPTION OF PREFERRED EMBODIMENTS

Referring to the drawing, there is illustrated a single well borehole extending from the surface through overburden 11 into hydrocarbonaceous formation 12. The overburden which overlaps the hydrocarbonaceous formation or deposit typically contains low resistance water zones or strata.

Positioned opposite the hydrocarbonaceous formation or pay zone 12 is lower or formation electrode 13 which is tubular in shape and has internal lower fluid flow passage 14. This tubular lower electrode member may be comprised of one or more pipe or casing joints and may include laterally extending electrode parts, such as for example, those described in U.S. Pat. No. 4,084,639 so long at least a portion of the lower electrode is tubular in shape and is adapted to conduct fluids from the formation. Lower electrode 13 will usually be comprised of steel. As shown, the electrode is one or more tubing or casing joints which have perforations 15, but the holes in the casing or tubing could have been preformed at the surface if the lower electrode is not cemented in place. Lower electrode 13 has outer surface 16 which is in contact with formation 12. This outer surface is kept relatively small for reasons hereinafter made clear.

The upper end of lower electrode 13 is shown connected to intermediate isolation means 17. This intermediate isolation means or member is comprised of one or more joints of electrically nonconducting material, such as, for example fiberglass, plastic or other nonconducting material. Intermediate isolation means 17 extends well above formation 12 for reasons hereinafter made clear. The isolation means is shown with internal intermediate fluid flow passage 18 which fluidly communicates with the upper end of lower electrode 13, but the intermediate tubular member does not necessarily need to conduct fluid. For example, an inner string of tubing (not shown) could be used to conduct fluids of the surface.

The upper end of tubular isolation means 17 is shown connected to overburden electrode 19 which is positioned in overburden 11. This overburden electrode is made of electrically conducting metal which is tubular in shape and is shown with internal upper fluid flow passage 20; but the upper tubular member does not necessarily need to conduct fluids to the surface. This tubular overburden or upper electrode member may be comprised of one or more joints of casing or tubing. This electrode is shown with outer surface 21 which is in contact with overburden 11. Upper electrode 19 could be comprised of more than one concentric casing or tubing strings whose exterior surfaces are at least partially in contact with the overburden.

For this invention, it is critical that outer surface 21 of upper electrode 19 be kept relatively large in comparison to outer surface 16 of lower electrode 13. For purposes of this disclosure, a surface area or length is relatively large if it is at least five times greater than the surface area or length with which it is being compared. In other words, the outer surface area and length of upper electrode 19 is at least five times greater than the outer surface area and length of lower electrode 13. This relative difference in surface areas between the electrodes is necessary to dissipating most of the power in pay zone or formation 12.

The amount of power dissipated in formation 12 is further enhanced if overburden or upper electrode 19 is comprised of electrically conducting nonmagnetic metal, such as for example, aluminum, stainless steel or other nonmagnetic metal. Aluminum is preferred because of its conductive properties and availability. In contrast, formation or lower electrode 13 is preferably made of ordinary magnetic steel.

The lower end of overburden electrode 19 is shown connected to the upper end of intermediate isolation means 17 so that internal flow passages 18 and 20 fluidly communicate with each other and with flow passage 14 in formation electrode 13. But it is not necessary that the overburden electrode be connected to the isolation section. For example, upper electrode could be an outer casing string. As shown, the internal flow passages through the electrodes and intermediate members form a passage for conducting fluids from formation 12 so that fluid oil may be produced at the surface of the earth.

As shown, formation electrode 13 is electrically connected to conductor 22 which is in turn connected to alternating current power source 23. Electrical connection to lower electrode 13 may be made in any standard fashion, for example, contacting friction dogs. Overburden electrode 19 is electrically connected to conductor 24 which is in turn connected to power source 23.

In operation, a borehole is drilled from the surface of the earth in any typical fashion into and perhaps through subsurface formation 12 containing hydrocarbonaceous materials, such as for example the Ugnu formation in Alaska, which upon being heated are lowered in viscosity and made more flowable. Steel tubular member or lower electrode 13, tubular electrically nonconducting isolation means 17 and tubular metal member or upper electrode 19 are lowered in typical fashion into the wellbore until the lower electrode member is positioned opposite and in contact with formation 12. Thereafter, alternating current source 23 is activated to produce a voltage of predetermined magnitude, for example, up to several thousand volts.

This causes an alternating current, for example, a current of up to 1200 amperes, to flow between lower formation electrode 13 and upper overburden electrode 19 through hydrocarbon containing formation 12 and overburden formation 11. Since the lower electrode has a relatively small exterior surface area and formation 12 contains hydrocarbonaceous substances that have a resistance higher than the formation waters contacting the exterior surface of upper electrode 19, most of the electrical power is dissipated at and in formation 12. This applies heat to the hydrocarbonaceous material and reduces its viscosity. The thus stimulated oil fluids flow through perforations 15 and into lower internal flow passage 14. The oil fluids then flow upwardly through tubular means to the surface as shown, the oil fluids flow upwardly through intermediate internal flow passage 18 into upper internal flow passage 20, and oil is produced at the surface of the earth.

Concentration of power dissipation at and in the pay zone formation is further enhanced by causing hysteresis losses in relatively long upper electrode 19 to be reduced. This is accomplished by using nonmagnetic metal, for example aluminum, for the electrode.

From the foregoing, it can be seen that this invention provides an improved single well apparatus and method for applying heat to a subsurface formation to stimulate oil production therefrom. This invention overcomes prior art deficiencies by keeping the surface area of the formation electrode relatively small in comparison to the upper electrode, and in some embodiments by use of nonmagnetic material for the upper electrode.

This invention has been described using a simplified drawing. It is understood that numerous known changes in details may be applied without departing from the spirit and scope of the claims. For example, multiple single well systems may be used in a pattern to enhance oil recovery or control heat effects. The well may contain one or more strings and pumping or other standard production enhancement techniques may be applied.

What is claimed is:

1. In a single well method of applying heat to a subsurface formation containing a viscous hydrocarbonaceous material to stimulate oil production therefrom, said subsurface formation being overlain by an overburden, the improvement comprising the steps of:

(a) causing an alternating current to flow between a lower metal electrode of relatively small surface area located essentially in said subsurface formation and an upper tubular metal electrode of relatively large surface area located in said overburden, said upper electrode being essentially comprised of an electrically conductive nonmagnetic metal thereby causing said current to flow through said upper electrode with reduced hysteresis losses in said upper electrode in comparison to the hysteresis losses that would occur if said upper electrode were essentially comprised of steel, at least a part of said lower electrode being tubular and being connected at its upper end to the lower end of an electrically nonconducting tubular isolation means; and (b) producing hydrocarbonaceous fluid through said lower electrode to the surface of the earth.

2. In the method of claim 1 wherein the upper electrode is comprised of aluminum.

3. In the method of claim 1 wherein said upper end of the electrically nonconducting tubular isolation means internally fluidly communicates with said upper tubular metal electrode thereby forming a passage for conducting fluids from said formation through said lower electrode through said electrically nonconducting tubular means through said upper electrode and the hydrocarbonaceous fluid is produced through said passage through said lower electrode, said nonconducting tubular means and said upper electrode.

4. A method for applying heat to a subsurface formation containing a viscous hydrocarbonaceous material to stimulate oil production therefrom through a borehole extending from the surface of the earth into said formation, said formation being overlain by an overburden comprising the steps of:

(a) lowering through said borehole an upper tubular metal member essentially comprised of an electrically conductive nonmagnetic metal, a lower steel tubular member and a tubular electrically nonconducting member, said lower steel tubular member being connected at its upper end to the lower end of said nonconducting member, said lower tubular member being lowered until it is positioned in said formation, said lower tubular member being much shorter than said upper tubular member;

(b) causing an alternating current to flow between said lower tubular member and said upper tubular member in a manner such that current flows through said upper tubular member with reduced hysteresis losses in said upper tubular member in comparison to the hysteresis losses that would occur if said upper electrode were essentially comprised of steel; and (c) producing hydrocarbonaceous fluid through said lower tubular member.

5. In the method of claim 4 wherein the upper tubular member is comprised of aluminum.

6. In the method of claim 4 wherein said lower tubular member, said nonconducting member and said upper tubular member are in fluid communication with each other and form a passage for conducting fluids from said formation to the surface of the earth and oil fluids are produced through said passage.

7. Apparatus for applying heat to a subsurface formation containing a hydrocarbonaceous material, said subsurface formation being overlain by an overburden, comprising:

(a) alternating current power source;

(b) lower steel electrode means positioned opposite said formation, said lower electrode means being electrically connected to said power source, at least a portion of said lower electrode means being tubular in shape, the outer surface of said lower electrode being in contact with said formation;

(c) upper electrically conductive nonmagnetic metal electrode means positioned in said overburden, said upper electrode means being electrically connected to said power source, said upper electrode being predominantly tubular in shape, the outer surface of said upper electrode means being in contact with said overburden; the surface area of said upper electrode means being at least five times larger than the surface area of said lower electrode means; and (d) electrically nonconductive tubular-shaped intermediate isolation means connected at its lower end to said lower electrode means.

8. The apparatus of claim 7 wherein the upper electrode is comprised of aluminum.

9. The apparatus of claim 7 wherein the upper end of said electrically nonconductive means is connected to said upper electrode means, and said lower electrode means, intermediate isolation means and lower electrode means form a conduit for passing fluid from said formation to the surface of the earth.

* * * * *